United States Patent [19]

Pabsch

[11] Patent Number: 4,574,535

[45] Date of Patent: Mar. 11, 1986

[54] MAST-TYPE THREE-DIMENSIONAL FRAMEWORK STRUCTURE

[75] Inventor: Arno R. E. K. Pabsch, Brunswick, Fed. Rep. of Germany

[73] Assignee: Deutsche Forschungs- und Versuchsanstalt für Luft- und Raumfahrt e.V., Cologne, Fed. Rep. of Germany

[21] Appl. No.: 721,692

[22] Filed: Apr. 10, 1985

[30] Foreign Application Priority Data

Apr. 14, 1984 [DE] Fed. Rep. of Germany ..... 3414220

[51] Int. Cl.[4] ..... E04H 12/10; E04H 12/18

[52] U.S. Cl. ..... 52/118; 52/646

[58] Field of Search ..... 52/118, 632, 645, 646, 52/648, 650, 108; 182/115, 152

[56] References Cited

U.S. PATENT DOCUMENTS

| | | | |
|---|---|---|---|
| 3,011,586 | 12/1961 | Harvey | 52/646 X |
| 3,486,279 | 12/1969 | Webb | 52/646 X |
| 3,564,789 | 2/1971 | Vyvyan et al. | 52/646 X |
| 3,771,274 | 11/1973 | Vaughan | 52/646 |
| 4,334,391 | 6/1982 | Hedgepeth et al. | 52/646 |

FOREIGN PATENT DOCUMENTS

| | | | |
|---|---|---|---|
| 957819 | 11/1974 | Canada | 52/646 |
| 2947656 | 7/1981 | Fed. Rep. of Germany . | |

*Primary Examiner*—J. Karl Bell

*Attorney, Agent, or Firm*—Salter & Michaelson

[57] ABSTRACT

A mast-type, three-dimensional framework structure of rectangular cross section with four diagonally-braced frames which form the sides of the framework structure and all of which are manufactured from tubes and tubular joints made from fibre-reinforced plastics. The diagonally-braced frames are so interconnected by means of hinged connections on their longitudinal members that they can be folded flat in such a way that two adjacent diagonally-braced frames lie in each case on top of the two opposite diagonally-braced frames. Between the longitudinal members of two opposite corners of the framework structure, fixed-length cables are fitted which, when the structure is unfolded, form a stay in one of the diagonals. Between the outer opposite corners, which are on the outside when the structure is folded, there are low-friction cable deflectors for a tensioning cable. The structure is unfolded by means of the tensioning cable and at the same time this forms a stay in the second diagonal of the unfolded framework structure.

8 Claims, 8 Drawing Figures

MAST-TYPE THREE-DIMENSIONAL FRAMEWORK STRUCTURE

FIELD OF THE INVENTION

The invention concerns a mast-type, three-dimensional framework structure of uniform rectangular section having four diagonally-braced frames which form the sides of the framework structure.

Framework structures of this type are used in many fields, for example for the towers of cranes, rigged aerial masts etc. Here the diagonally-braced frames of adjacent sides always have common longitudinal members.

Framework structures of the above type appear to be suitable for the provision of fairly large space structures in earth orbits. In this case the problem is that of transporting such structures into orbit and assembling them in orbit. For transportation, the desire is for the smallest possible transportation volume. This would best be achieved by transporting the structures into orbit as individual components. In sapce, however, possibilities of assembling the individual parts to form the space structures are limited.

The object of the invention is to develop a framework structure which meets as far as possible the requirements for low transportation volume and easy assembly in orbit.

SUMMARY OF THE INVENTION

This object is achieved according to the invention in that said structure comprises four separate diagonally-braced frames manufactured from tubes and tubular joints; hinged connections interconnecting longitudinal members of said frames, whereby said frames can be folded flat in such a way that two adjacent diagonally-braced frames lie, in each case, flat on top of the two opposite diagonally-braced frames; fixed lengths of cables fitted between said longitudinal members of the flat frameworks, which cables, when the structure is unfolded, form a stay in one of the diagonals of respective frames, and, between the other longitudinal members, low friction cable deflectors and a tensioning cable so arranged that when said structure is unfolded, said tensioning cable forms a stay in the other diagonal of respective frames, said tensioning cable between the points of deflection always extending along at least one of said longitudinal members.

The hinged connections may be arranged at the joints in the framework.

The hinged connections may comprise hinges each having a pair of hinge plates which are mounted apart and which are integral with the framework joints, and a through hinge bolt interconnecting the hinge plates.

Alternatively, the hinged connections may each comprise a pair of hinge plates, a hinge bolt on which the hinge plates are pivotally mounted, and U-shaped shackles between the legs of which cable deflectors are fitted.

A single cable deflector may be provided in one corner of the framework structure and two independent cable deflectors are provided in the opposite corner. The tensioning cable may be led, in each frame, along longitudinal members thereof in one corner of the framework structure and close the joints is always led diagonally to the opposite joint by means of a two-cable pulley block.

The tensioning cable may be led alternately diagonally and longitudinally along said longitudinal members in zig-zag fashion.

The tubes and tubular joints from which the frames are constructed may be made of fibre-reinforced plastic.

The framework structure according to the invention can be folded down flat for transportation into space and can there be changed into its final shape by operating the tensioning cable.

BRIEF DESCRIPTION OF THE DRAWINGS

The inventiion is illustrated by way of example in the drawings and is described in detail below with reference to the drawings.

DESCRIPTION OF THE PREFERRED EMBODIMENT

Figure 1:
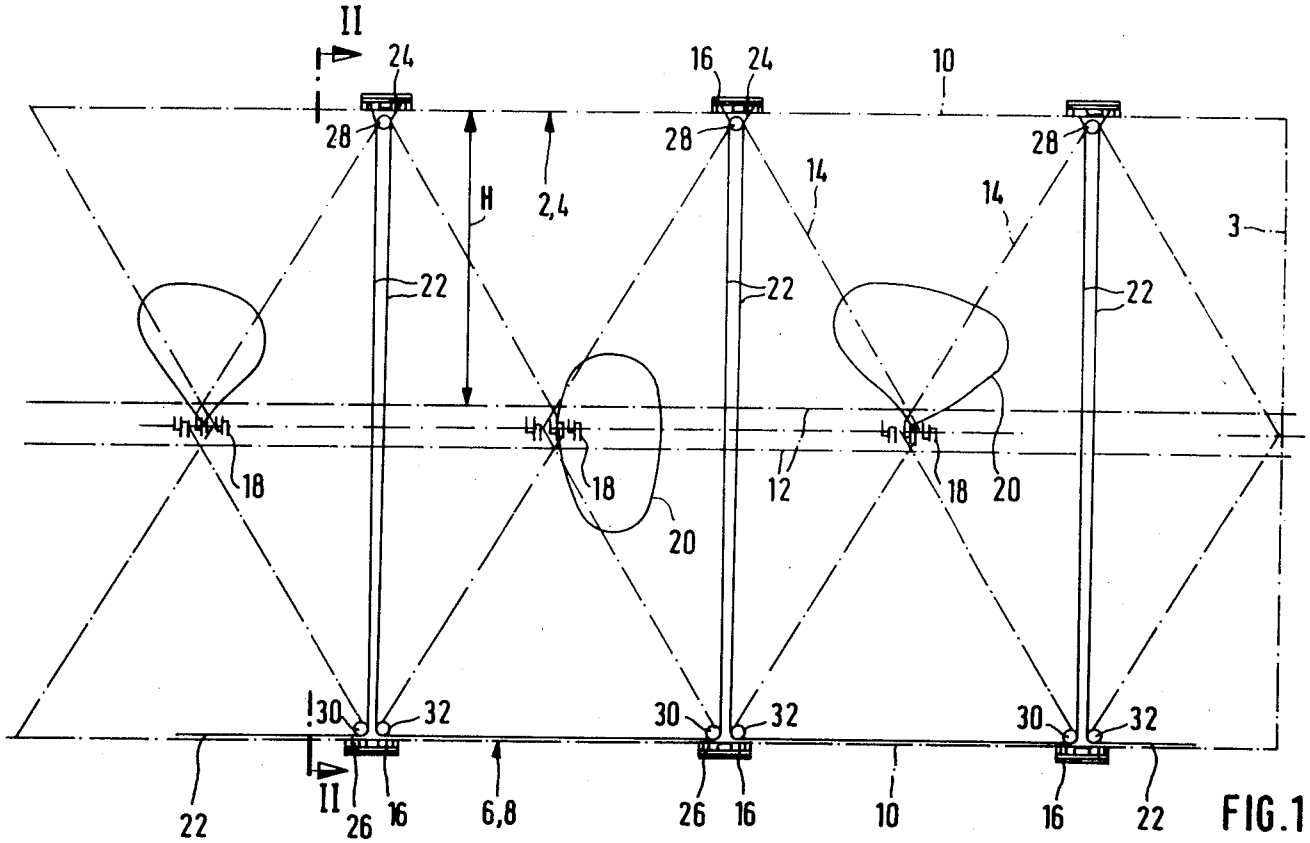
FIG. 1 shows a plan view of a section of a framework structure according to the invention, shown in its folded state.

FIG. 1 shows a framework structure in its folded state. The three-dimensional framework structure possesses four diagonally-braced frmaes 2, 4 and 6, 8 of the same height H, the members of which should preferably be in the form of congruent triangles. The diagonally-braced frames each possess parallel longitudinal members 10, 12 between which the struts 14 are set at an angle of 60°. The connecting joints are not shown in detail in FIG. 1. The diagonally-braced frames are connected to each other at their longitudinal members 10, 12 by means of hinged connections 16, 18 which are fitted close to the joints.

The longitudinal members 10, 12 and the struts 14 are wound carbon fibre reinforced plastic tubes, and the joints are also wound in carbon fibre reinforced plastics in the form of tubular elements. The tubular sections are in each case adhesive-bonded to the joints. A structure of this kind possesses a high degree of rigidity with very low weight. Thwe tubular structure can be seen in FIGS. 2 to 4.

Figure 2:
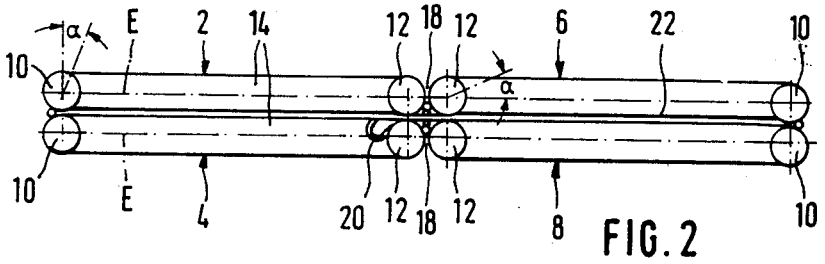
FIG. 2 shows a section along the line II—II in FIG. 1.

As shown in FIG. 2., in each case two diagonally-braced frames 2, 6 and 4, 8 are interconnected via the hinged connections 16 or 18 in such a way that two adjacent diagonally-braced frames 2, 6 or 4, 8 lie in pairs and these two pairs in their flat condition lie directly on top of each other. Between the hinged connections 18 in the centre between the members 12, which lie side by side when the diagonally-braced frames 2 and 6 or 4 and 8 are in their flat condition, are stay cables 20, the fixed length of which corresponds to the diagonal of the framework structure in its unfolded state. They are retained by shackles on the hinge bolts as will be described in detail hereinafter.

U-shaped shackles 24, 26 are swivel-mounted on the hinge bolts of the hinged connection 16 which is positioned on the outside when the structure is folded. In the shackles 24 on one side a deflector pulley wheel 28 is fitted, whilst in the shackles 26 on the other side two deflecting pulley wheels 30, 32, which are independent of each other, are fitted in such a way that they are able to revolve. As shown in the drawing, these are preferably arranged on parallel axes independently of each other, but may also be mounted on a common axle bolt in such a way that they are able to rotate.

In the example illustrated, a tensioning cable 22 is led between the individual joints along one of the members 10 of the diagonally-braced frames 6 and 8 which are situated on the outside when the structure is in its folded condition. The tensioning cable 22 is then led via one of the pulley wheels in shackle 26 at right angles to the structure over the pulley wheel in the opposite shackle 24 and then back again over the other pulley wheel in shackle 26. In this way a two cable pulley block is formed. In this way the tensioning cable 22 passes in each case at right angles through the structure, preferably from all the joints.

Figure 3:
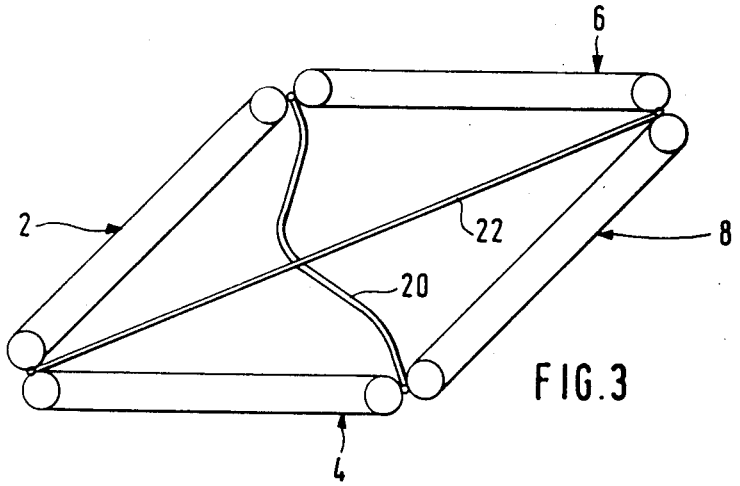
FIG. 3 shows the same section of the structure at an intermediate stage during unfolding.
Figure 4:
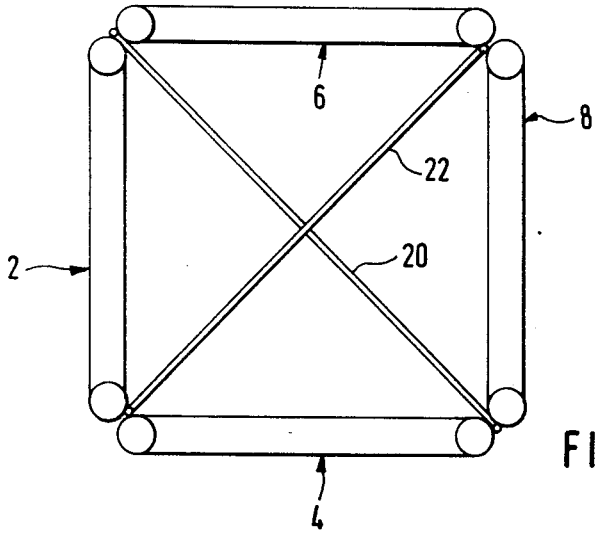
FIG. 4 shows the same section of the structure when completely unfolded.

By drawing in the tensioning cable 22, e.g. by means of a winch attached to the structure, the flat folded structure can be unfolded, as can be seen in the sequence of drawings in FIGS. 2, 3 and 4. The unfolding is complete when the fixed lengths of cable 20 are extended. Then the rectangular, preferably square cross section in FIG. 4 is attained. The tensioning cable 22 is then fixed by locking the winch drum or by means of a ratchet mechanism. A high degree of tensioning force in the diagonal of the framework structure is achieved with low tensioning effort as a result of leading the tensioning cable 22 via the two-cable pulley block. Since this tension is taken up by two lengths of cable, the cable can be overall relatively thin and consequently can be of low mass. With a frame height H of 2 m, for example, the tensioning cable can be of diameter 2 mm.

The framework structures of the described design should preferably form individual sections from which longer framework structures can be produced by connecting these sections together, and from these it is possible in turn to construct further frame structures.

The individual diagonally-braced frames may, as shown in FIG. 1 by hatched lines, be finished at the ends by means of vertical supports 3, thus forming the individual sections of which several can be joined together. It is, however, also possible to provide at one end open tube ends which can be inserted during assembly into the appropriate joint connectors of a section which is to be connected. Several stacked sections can also be interconnected on pivots, the connection in this case preferably being carried out in concertina fashion when more than two structures are involved. The connections may be such that the individual structures connected in this way are unfolded automatically and if appropriate may be connected together still in their folded condition when they are fully extended. Longitudinal connection may then be carried out by means of longitudinal tensioning cables, for example, which pass within the longitudinal members. The whole structure made up of several structural sections can then be unfolded by means of the tensioning cable which can also run over several structural sections. Then the longitudinal tensioning cables in the longitudinal members can be fully tensioned and locked.

Figure 5:
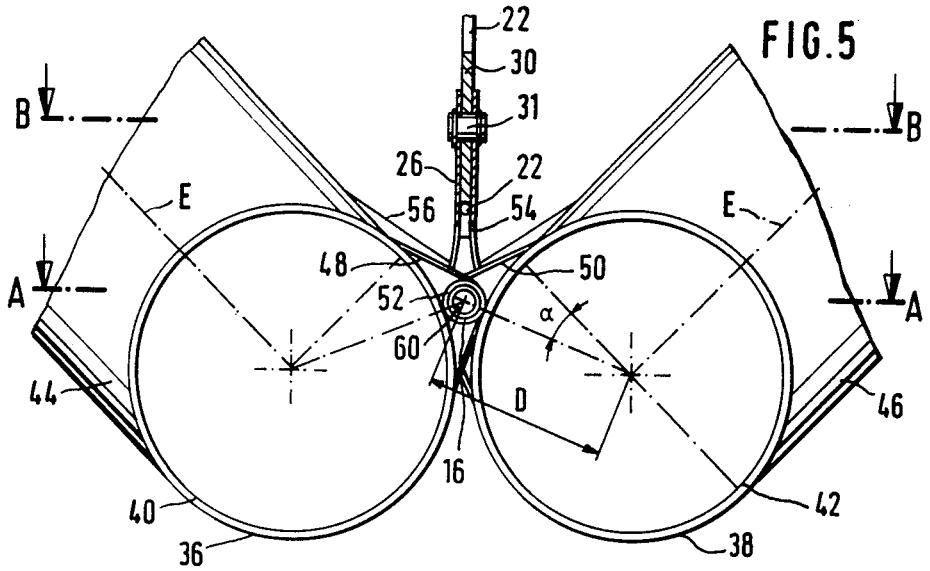
FIG. 5 is a larger-scale view of a section through a joint when the structure is in its unfolded state and close to the longitudinal members to which a tensioning cable is attached.
Figure 6A:
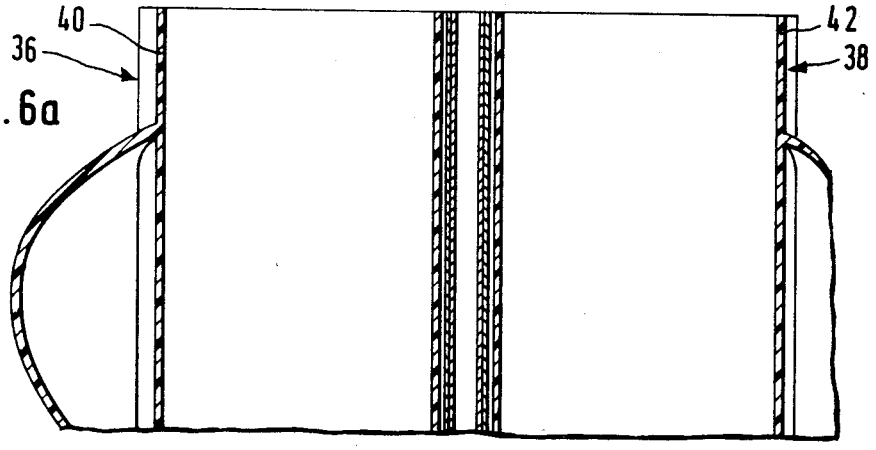
FIG. 6*a* shows a section along line A—A in FIG. 5.
Figure 6B:
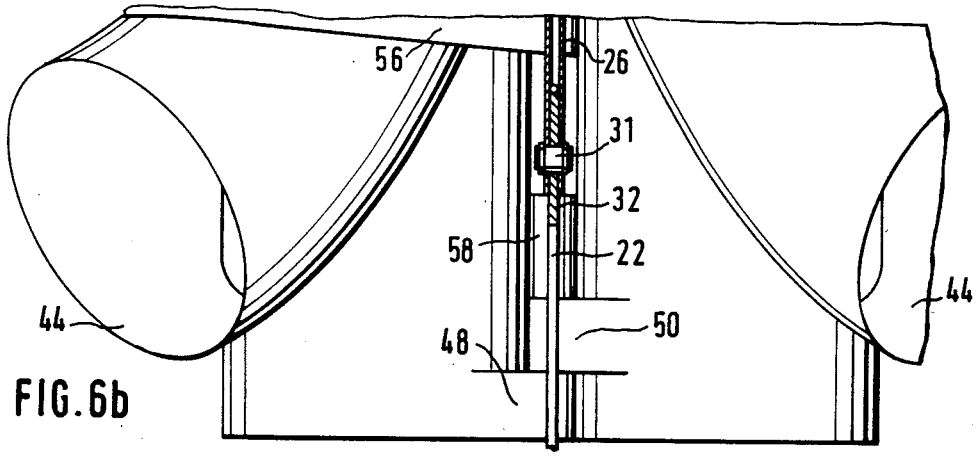
FIG. 6*b* shows a section along line B—B in FIG 5.

FIGS. 5 and 6*a* and 6*b* illustrate a preferred form of a hinged connection. This is one of the hinged connections 16 between the longitudinal members 10 which lie on the outside in the folded state of the structure. The hinged connection 16 is close to two opposed joint elements 36, 38. These joint elements possess open socket sections 40, 42 close to the longitudinal members, into which the tubes of the longitudinal members are inserted and bonded. At an angle of 30° to the vertical, connection sockets 44, 46 are provided at each joint, and these are wound in one piece together with the tube sockets 40.

The two joint elements 36 and 38 are also provided with hinge plates 48, 50 close to their ends. These hinge plates possess hinge bushes 52, which are retained in position against the outside circumference of the tubular socket 40 by means of strands of winding. The hinge bushes may also be mouldings which are enveloped by the strands of winding. The axis of the hinge bushes is at an angle of $\alpha$ (which corresponds to half the angle of pivot of the hinge) to the vertical through plane E of the joint. The strands of winding are wound in one and the same process with the framework joints. At each end of the joint two such hinge plates 48, 50 are provided in each case. The hinge bolt extends over the whole length. Further bearing bushes may be provided in the middle of the joint, as indicated by the strand of winding 56 in FIG. 6*b*. The hinge axis lies at a distance D from the axis of the socket sections 40, 42 and consequently also of the tubular longitudinal members 10.

The U-shaped hinged shackle 24 or 26 is pivot-mounted on a through hinge bolt 60. In the illustrations in FIGS. 5 and 6*a* and 6*b* this is the shackle 26 with the two profiled cable pulley wheels 30 or 32 which are situated on parallel axle pins 31 at some distance apart. If a central hinge connection is also provided, the shackle 26 can pass over this hinge connection in the form of a bridge. Spacers 58 can also be arranged on the hinge bolt 60 to hold the shackle 26 in position axially. The tensioning cable 22 is guided laterally by the legs of the shackle.

The transportation packing height of the folded structure is determined by the thickness of the shackles 26 between the joints. In order to keep this low, the external contour of the shackle can, for example, be matched to the external contour of the joint in such a way that at the point where it lies between the joints when the structure is folded the shackle is provided on both sides with a lengthwise concave portion 54. At the deepest point of the concave section the two legs can lie immediately on top of each other. The distance D is set according to this.

The shackle 24 is mounted on the hinged connection on the opposite side of The structure in the same way as with shackle 26. In this case, however, the shackle is provided with only one diverting pulley wheel.

The fixed lengths of cable can be provided with cable eyes or similar connector at their ends, and a U-shaped fixing shackle can be provided, into which the cable eye is inserted and fastened with a through bolt. These fixing shackles are pivotally mounted in the same way on the hinged connections 18 which are moreover formed in the same way on the joints as the hinged connections 16.

Figure 7:
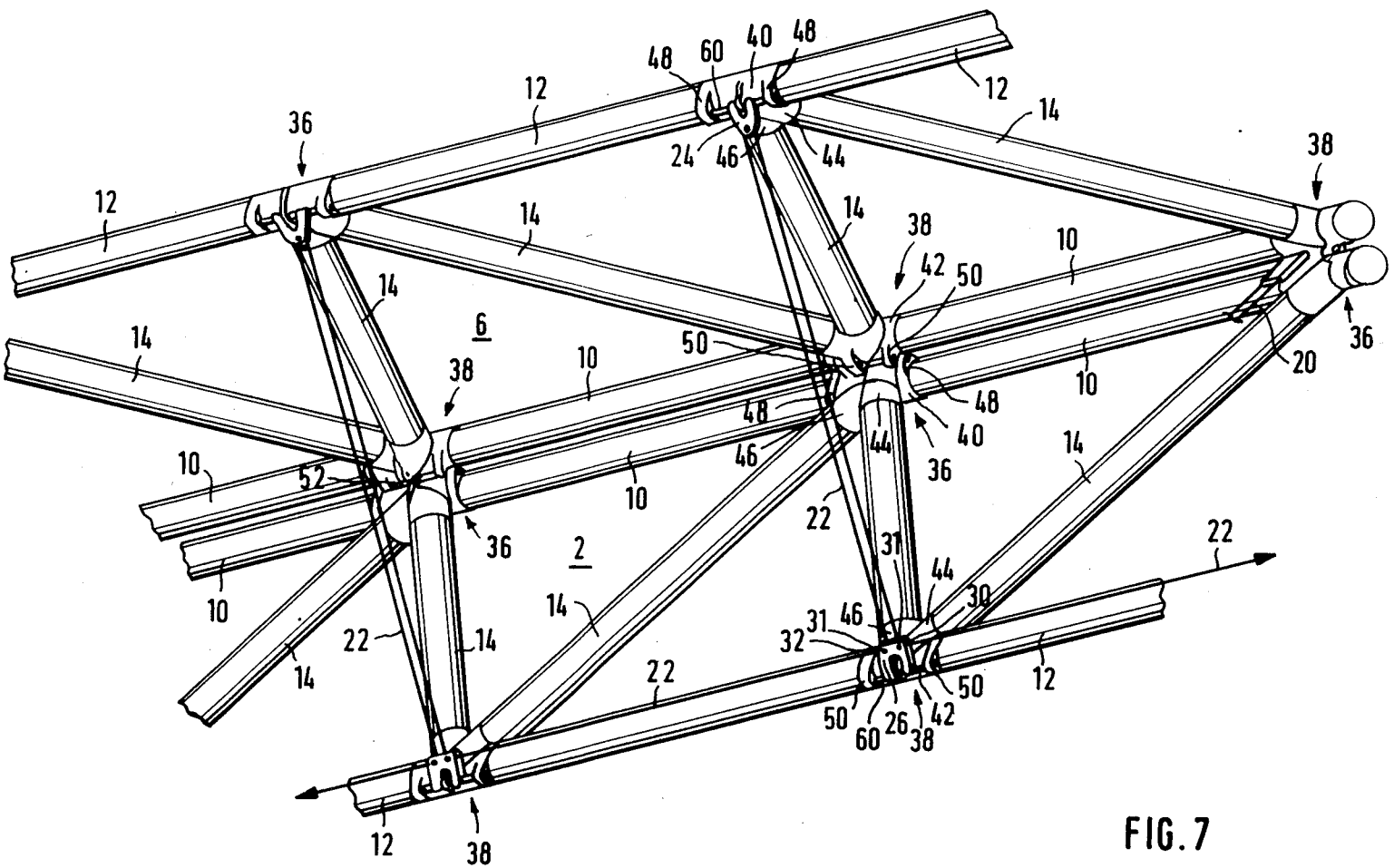
FIG. 7 is a perspective view of two adjacent diagonally-braced frames in the unfolded state shown in FIG. 4.

Details of the design of the diagonally-braced frames and the joint elements can be seen in the perspective view shown in FIG. 7. FIG. 7 shows two adjacent diagonally-braced frames which lie side by side when the structure is folded, i.e. frames 2 and 6 or 4 and 8. The two other diagonally-braced frames have been omitted for reasons of clarity. These are hinge-mounted to the joints 36 or 38 on the two diagonally-braced frames 2 and 6. The fixed lengths of cable 20 are not shown in full. In the unfolded condition of the structure, as shown in FIG. 4, these are taut under tension between the hinged connections between the diagonally-braced frames 2 and 4 or 6 and 8.

Folding solar panel wings, for example, can be fitted within the framework spaces of a framework structure of the above type in such a way that transporation volume is not increased. In this way high-performance solar panel areas can be provided in space, using pre-assembled units within an enclosed frame structure formed from framework structures of the aforesaid type. The arrangement of the solar panel wings may and indeed should be carried out in such a way that any thrust forces resulting from loading on one side will be transferred to the rest of the structure by means of the fixed cable diagonals.

What I claim as my invention and desire to secure by Letters Patent of the United States is:

1. A mast-type, three-dimensional framework structure of uniform rectangular section having four diagonally-braced frames forming the sides of the framework structure, comprising four separate diagonally-braced frames manufactured from tubes and tubular joints; hinged connections interconnecting longitudinal members of said frames, whereby said frames can be folded flat in such a way that two adjacent diagonally-braced frames lie, in each case, flat on top of the two opposite diagonally-braced frames; fixed lengths of cables fitted between said longitudinal members of the flat frameworks, which cables, when the structure is unfolded, form a stay in one of the diagonals of respective frames, and, between the other longitudinal members, low friction cable deflectors and a tensioning cable so arranged that when said structure is unfolded, said tensioning cable forms a stay in the other diagonal of respective frames, said tensioning cable between the points of deflection always extending along at least one of said longitudinal members.

2. A framework structure in accordance with claim 1, in which said hinged connections are arranged at the joints in the framework.

3. A framework structure in accordance with claim 2 having hollow framework joints, in which the hinged connections comprise hinges each having a pair of hinge plates which are mounted apart and which are integral with the framework joints, and a through hinge bolt interconnecting the hinge plates.

4. A framework structure in accordance with claim 1, in which the hinged connections each comprise a pair of hinge plates, a hinge bolt on which the hinge plates are pivotally mounted, and U-shaped shackles between the legs of which cable deflectors are fitted.

5. A framework structure in accordance with claim 4, in which a single cable deflectornis provided in one corner of the framework structure and two independent cable deflectors are provided in the opposite corner.

6. A framework structure in accordance with claim 1, in which said tensioning cable is led, in each frame, along longitudinal members thereof in one corner of the framework structure and close to the joints is always led diagonally to the opposite joint by means of a two-cable pulley block.

7. A framework structure in accordance with claim 1, in which said tensioning cable is led alternately diagonally and longitudinally along said longitudinal members in zig-zag fashion.

8. A framework structure in accordance with claim 1, in which the tubes and tubular joints from which the frames are constructed are made of fibre-reinforced plastic.

* * * * *